US008974091B2

(12) United States Patent
Huang

(10) Patent No.: US 8,974,091 B2
(45) Date of Patent: Mar. 10, 2015

(54) HEAT-DISSIPATING STRUCTURE FOR AN LED LAMP

(75) Inventor: David Huang, Taipei (TW)

(73) Assignee: Liquidleds Lighting Corp., Taipei (TW)

( * ) Notice: Subject to any disclaimer, the term of this patent is extended or adjusted under 35 U.S.C. 154(b) by 0 days.

(21) Appl. No.: 13/596,133

(22) Filed: Aug. 28, 2012

(65) Prior Publication Data

US 2014/0063806 A1 Mar. 6, 2014

(51) Int. Cl.

| | |
|---|---|
| ***F21V 29/00*** | (2006.01) |
| ***F21V 15/01*** | (2006.01) |
| ***F21V 19/00*** | (2006.01) |
| *F21K 99/00* | (2010.01) |
| *F21V 23/02* | (2006.01) |
| *F21Y 101/02* | (2006.01) |

(52) U.S. Cl.

CPC ..... *F21V 29/2293* (2013.01); *F21V 15/011* (2013.01); *F21V 19/0055* (2013.01); *F21K 9/00* (2013.01); *F21V 23/023* (2013.01); *F21Y 2101/02* (2013.01); *Y10S 362/80* (2013.01)

USPC ..... 362/373; 362/249.01; 362/249.02; 362/294; 362/362; 362/218; 362/800; 362/264; 362/345; 362/547

(58) Field of Classification Search

USPC ..... 362/249.01, 249.02, 294, 373, 800, 362/362, 218, 264, 345, 547

See application file for complete search history.

(56) References Cited

U.S. PATENT DOCUMENTS

| | | | | |
|---|---|---|---|---|
| 7,628,513 | B2 * | 12/2009 | Chiu | 362/311.02 |
| 7,701,055 | B2 * | 4/2010 | Wu et al. | 257/712 |
| 7,891,842 | B2 * | 2/2011 | Lu et al. | 362/267 |
| 8,388,197 | B1 * | 3/2013 | Huang et al. | 362/373 |
| 2009/0141508 | A1 * | 6/2009 | Peng et al. | 362/373 |
| 2010/0214781 | A1 * | 8/2010 | Chiu et al. | 362/249.06 |
| 2010/0259934 | A1 * | 10/2010 | Liu et al. | 362/294 |
| 2012/0051068 | A1 * | 3/2012 | Pelton et al. | 362/373 |
| 2012/0140490 | A1 * | 6/2012 | Rowlette et al. | 362/373 |
| 2012/0195053 | A1 * | 8/2012 | Wu | 362/373 |

* cited by examiner

*Primary Examiner* — Diane Lee
*Assistant Examiner* — Mitchell Errett
(74) *Attorney, Agent, or Firm* — Alan D. Kamrath; Kamrath IP Lawfirm, P.A.

(57) ABSTRACT

A heat-dissipating structure for an LED lamp has a lamp cover, and a power conversion device and a ceramic substrate mounted inside the lamp cover. The lamp cover has multiple heat-dissipating holes and multiple mounting ears. Each mounting ear is formed on an edge of one of the heat-dissipating holes and is bent inwardly with the heat-dissipating hole uncovered. The ceramic substrate is mounted on the mounting ears. The ceramic substrate has multiple LEDs mounted thereon, absorbs heat generated when the LEDs emit light and conducts the heat to the lamp cover through the mounting ears. The heat generated when the LEDs are lit and the power conversion converts a mains power is transferred to a heat convection space between the ceramic substrate and the lamp cover, and is further dissipated to an ambient environment, thereby achieving fast heat dissipation and a light LED lamp without an additional heat sink thereon.

6 Claims, 6 Drawing Sheets

HEAT-DISSIPATING STRUCTURE FOR AN LED LAMP

BACKGROUND OF THE INVENTION

1. Field of the Invention

The present invention relates to a heat-dissipating structure and, more particularly, to a heat-dissipating structure for an LED (light-emitting diode) lamp.

2. Description of the Related Art

To cope with global energy depletion, the government of every country stipulates different policies advocating for energy conservation. In response to the call, LED appears to be the lighting element receiving the most attention recently. Many electronic appliances developed with LED, such as LED televisions, LED lamps and the like, are widely favored by consumers.

The development of LED lamps has become increasingly mature in recent years, and LED lamps are commonplace everywhere. Regular families prefer LED bulbs more, because users can perfectly mount the LED bulbs in the original light bulb sockets without replacing the original lamp set, thereby saving users' effort and expense.

When LEDs are powered on to emit light, considerable heat is generated. If not quickly dissipated, the heat will be accumulated. The temperature rise caused by the accumulated heat will destroy the LEDs. To tackle such issue, manufacturers of LED lamps attempt to improve the heat dissipation by changing the structure of the LED lamps externally. With reference to FIGS. 5 and 6, a conventional LED lamp has a light source substrate 90, a power conversion device 91, a heat sink 92 mounted around the light source substrate 90 and the power on a lower end of the heat sink 92 and has multiple LEDs 95 mounted on a bottom thereof. The power conversion device 91 is mounted on an upper end of the heat sink 92 and is electrically connected to a mains power and the light source substrate 90. The top cover 93 is mounted on a top opening of the heat sink 92 to seal the power conversion device 91. The chamber 94 is defined between the light source substrate 90 and the power conversion device 91. When the LEDs on the light source substrate 90 are lit and generate heat, the chamber 94 above the light source substrate 90 accumulates heat. Moreover, the power conversion device 91 also generates heat when converting the AC power into DC power. It is the heat sink 92 that quickly dissipates the heat generated from the light source substrate 90 and the power conversion device 91 outside of the LED lamp.

Although the conventional LED lamp can dissipate heat through the heat sink 92, it is more likely than not that the heat generated by the light source substrate 90 and the power conversion device 91 still accumulates in the chamber 94 to cause a high temperature rise as the heat sink 92 only contacts peripheries of the light source substrate 90 and the power conversion device 91. If the accumulated heat inside the chamber 94 is not dissipated soon enough, the light source substrate 90 or the power conversion device 91 can be easily damaged. Besides, the heavy heat sink 92 also causes inconvenience in assembly of the LED lamp.

SUMMARY OF THE INVENTION

An objective of the present invention is to provide a heat-dissipating structure for an LED lamp capable of rapidly dissipating heat through a heat convection effect.

To achieve the foregoing objective, the heat-dissipating structure for an LED lamp has a lamp cover, a ceramic substrate and a power conversion device.

The lamp cover has a peripheral wall, multiple heat-dissipating holes and multiple mounting ears. The heat-dissipating holes are formed through the peripheral wall.

Each mounting ear is formed on an edge of one of the heat-dissipating holes, and is bent inwardly with the heat-dissipating hole uncovered.

The ceramic substrate is mounted inside the lamp cover, is securely mounted on the mounting ears, and has multiple light-emitting diodes (LEDs) mounted thereon.

The power conversion device is mounted on the lamp cover, faces the ceramic substrate, and is electrically connected to the LEDs on the ceramic substrate.

An LED lamp having the foregoing heat-dissipating structure acquires the mains power through the power conversion device and transmits the converted power to the ceramic substrate so that each LED on the ceramic substrate is turned on to emit light. The heat generated when each LED emits light is first absorbed by the ceramic substrate, and the remaining heat is conducted to the mounting ears and the entire lamp cover. The heat absorbed by the ceramic substrate and generated when the power conversion device converts the mains power is transferred to the heat convection space, which is defined between the ceramic substrate and the lamp cover, through the heat convection effect and is further dissipated to ambient air around the LED lamp through the heat-dissipating holes of the lamp cover. Accordingly, the heat generated when the LEDs are lit and when the power conversion device converts the mains power is not accumulated and can be quickly dissipated. Also, since the lamp cover has no heat sink or other heat-dissipating module mounted thereon, the LED lamp is light in weight.

Other objectives, advantages and novel features of the invention will become more apparent from the following detailed description when taken in conjunction with the accompanying drawings.

DETAILED DESCRIPTION OF THE INVENTION

Figure 1:
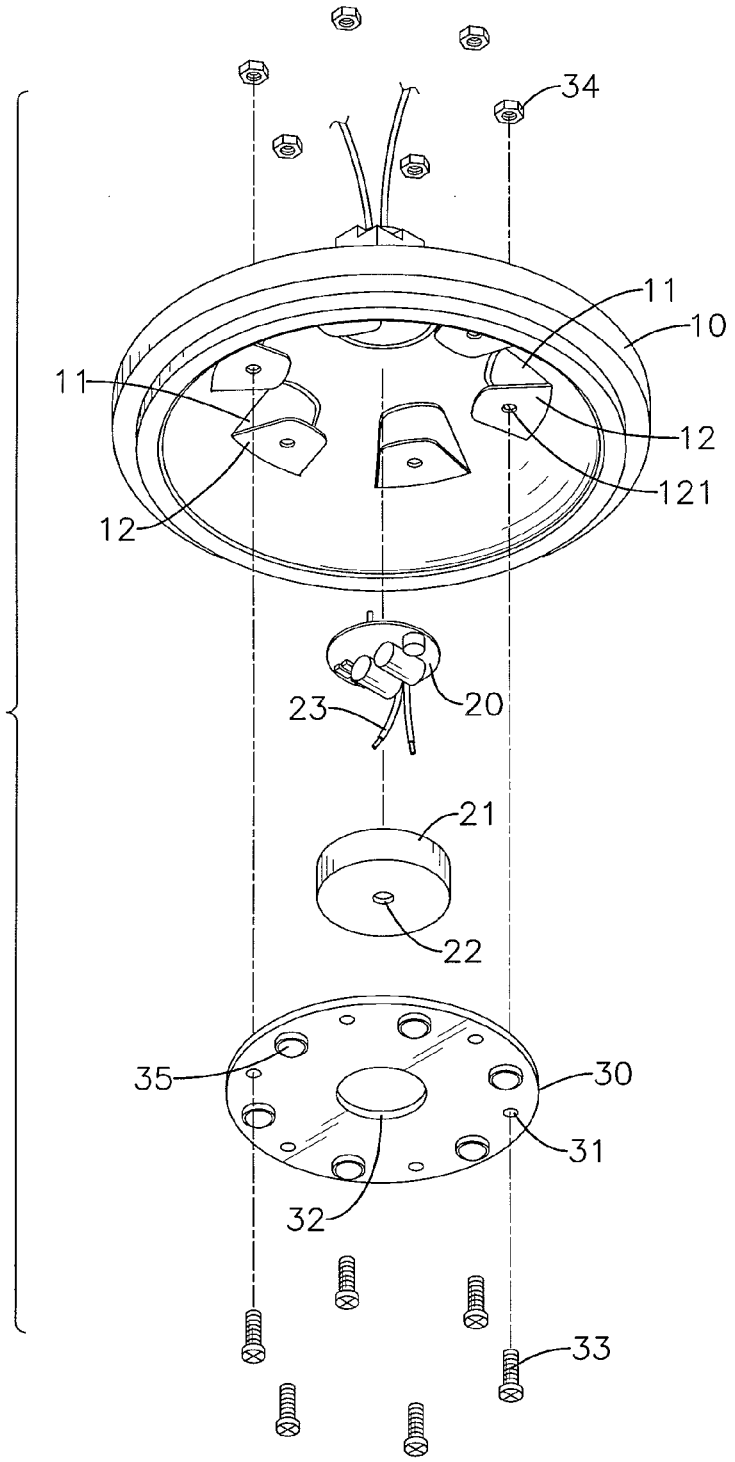
FIG. 1 is an exploded perspective view of an embodiment of a heat-dissipating structure for an LED lamp in accordance with the present invention.

With reference to FIG. 1, an embodiment of a heat-dissipating structure for a lamp in accordance with the present invention has a lamp cover 10, a power conversion device 20 and a ceramic substrate 30.

The lamp cover 10 is funnel-shaped and has multiple heat-dissipating holes 11 and multiple mounting ears 12. The heat-dissipating holes 11 are formed through a peripheral wall of the lamp cover 10. Each mounting ear 12 is formed on an edge of one of the heat-dissipating holes 11, is bent inwardly with the corresponding heat-dissipating hole 11 uncovered, and has a through hole 121 formed through the mounting ear 12. In the present embodiment, the lamp cover 10 is made of an aluminum material.

The power conversion device 20 is mounted inside a power cap 21, is located inside the lamp cover 10, and converts AC power acquired from the mains power into DC power as an operating power to the LED lamp. The power cap 21 has a cable hole 22 formed through the power cap 21 for at least one power cable 23 to penetrate through the power cap 21, and is electrically insulating to avoid the risk of electric shock.

Figure 2:
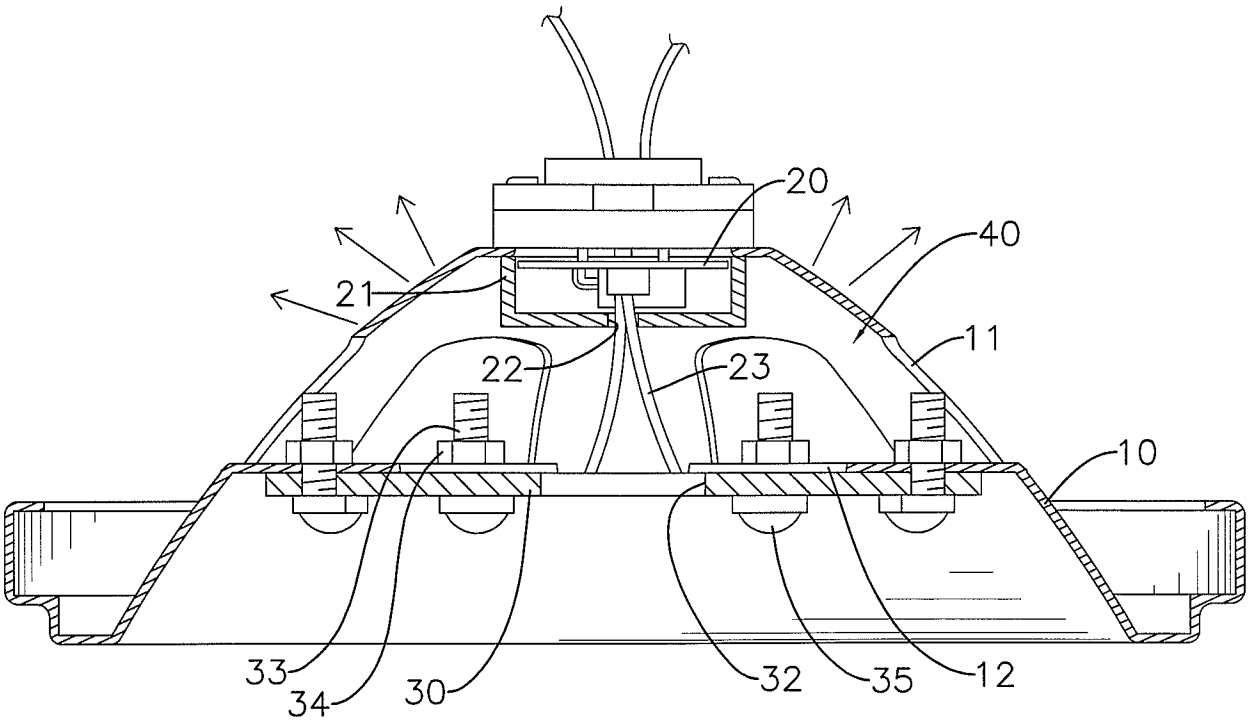
FIG. 2 is a side view in partial section of the heat-dissipating structure for the LED lamp in FIG. 1.

The ceramic substrate 30 is mounted inside the lamp cover 10, is securely connected with the mounting ears 12, faces the power conversion device 20, and has an air passage hole 32, multiple threaded holes 31, multiple bolts 33 and multiple LEDs 35. The air passage hole 32 is centrally formed through the ceramic substrate 30. Each threaded hole 31 is formed through the ceramic substrate 30 to correspond to the through hole 121 of a corresponding mounting ear 12. Each bolt 33 is mounted through one of the threaded holes 31 of the ceramic substrate and the through hole 121 of a corresponding mounting ear 12 and is screwed with a nut 34. The LEDs 35 are mounted on the ceramic substrate 30. In the present embodiment, the ceramic substrate 30 is made of a ceramic material, has a good heat-dissipating capability, and is electrically insulating, thereby avoiding power to be transmitted to the lamp cover 10 through the ceramic substrate 30 and the risk of electric shock. With reference to FIG. 2, the power conversion device 20 is connected to the ceramic substrate 30 through the at least one power cable 23. The at least one power cable 23 penetrates through the cable hole 22 on the power cap 21. Except the junction of the at least one power cable 23 and the ceramic substrate 30, the rest of the portion of the at least one power cable 23 is sheathed with an insulating layer for the purpose of electric insulation to avoid the risk of shock due to users' advertent contact.

Figure 3:
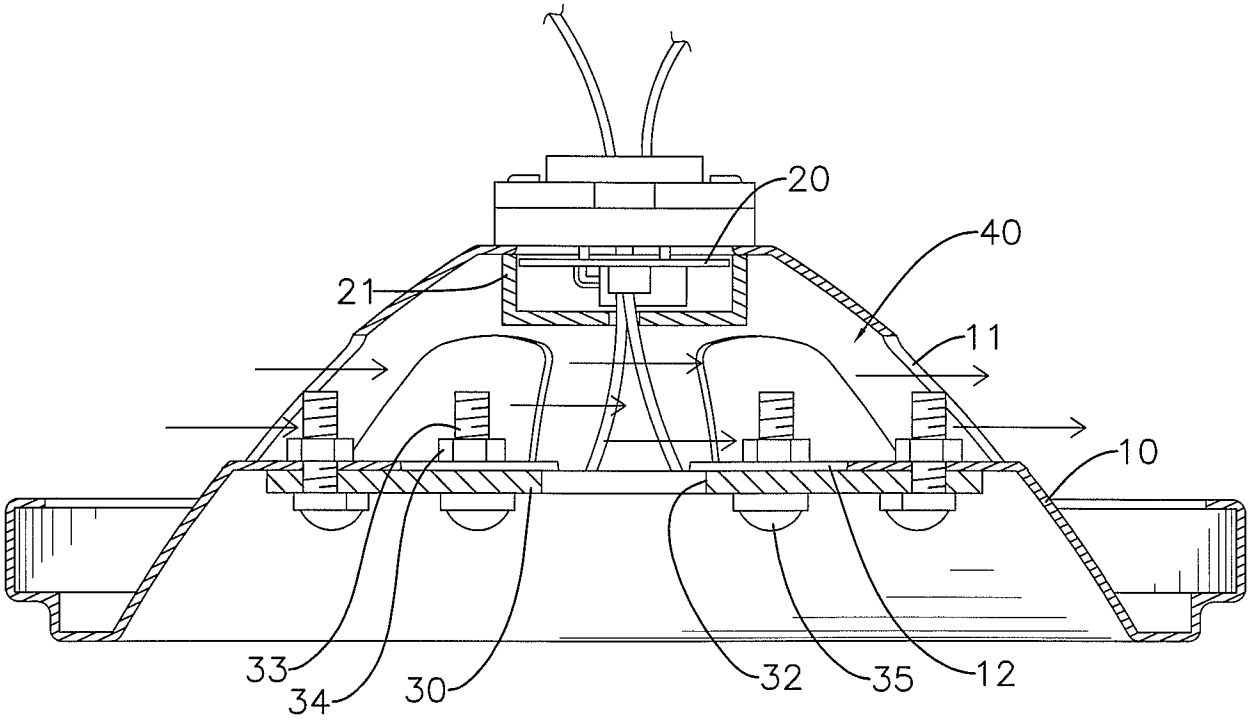
FIG. 3 is an operational side view in partial section of the heat-dissipating structure for the LED lamp in FIG. 1.

An LED lamp having the foregoing heat-dissipating structure acquires the mains power through the power conversion device 20 and transmits the converted power to the ceramic substrate 30 through the at least one power cable 23 so that each LED 35 on the ceramic substrate 30 is turned on to emit light. Since the ceramic substrate 30 is made of a ceramic material and thus has an optimal heat-dissipating effect and since the mounting ears 12 contact the ceramic substrate 30, the heat generated when each LED emits light is first absorbed by the ceramic substrate 30, and the remaining heat is conducted to the mounting ears 12 and the entire lamp cover 10. The heat on the lamp cover 10 is transferred to ambient air. A heat convection space 40 is defined between the ceramic substrate 30 and the lamp cover 10. With reference to FIG. 3, the heat absorbed by the ceramic substrate 30 is transferred to the heat convection space 40 through a heat convection effect and is further dissipated to ambient air around the LED lamp through the heat-dissipating holes 11. The heat generated when the power conversion device 20 converts the mains power into DC power may be absorbed by the power cap 21. Similarly, the heat absorbed by the power cap 21 is transferred to the heat convection space 40 through a heat convection effect and is further dissipated to ambient air around the LED lamp through the heat-dissipating holes 11 of the lamp cover 10 and the air passage hole 32 of the ceramic substrate 30. Accordingly, the heat generated when the LEDs are lit and when the power conversion device converts the mains power is not accumulated and can be quickly dissipated. As the lamp cover 10 has no heat sink or other heat-dissipating module mounted thereon, the LED lamp is light in weight.

Figure 4:
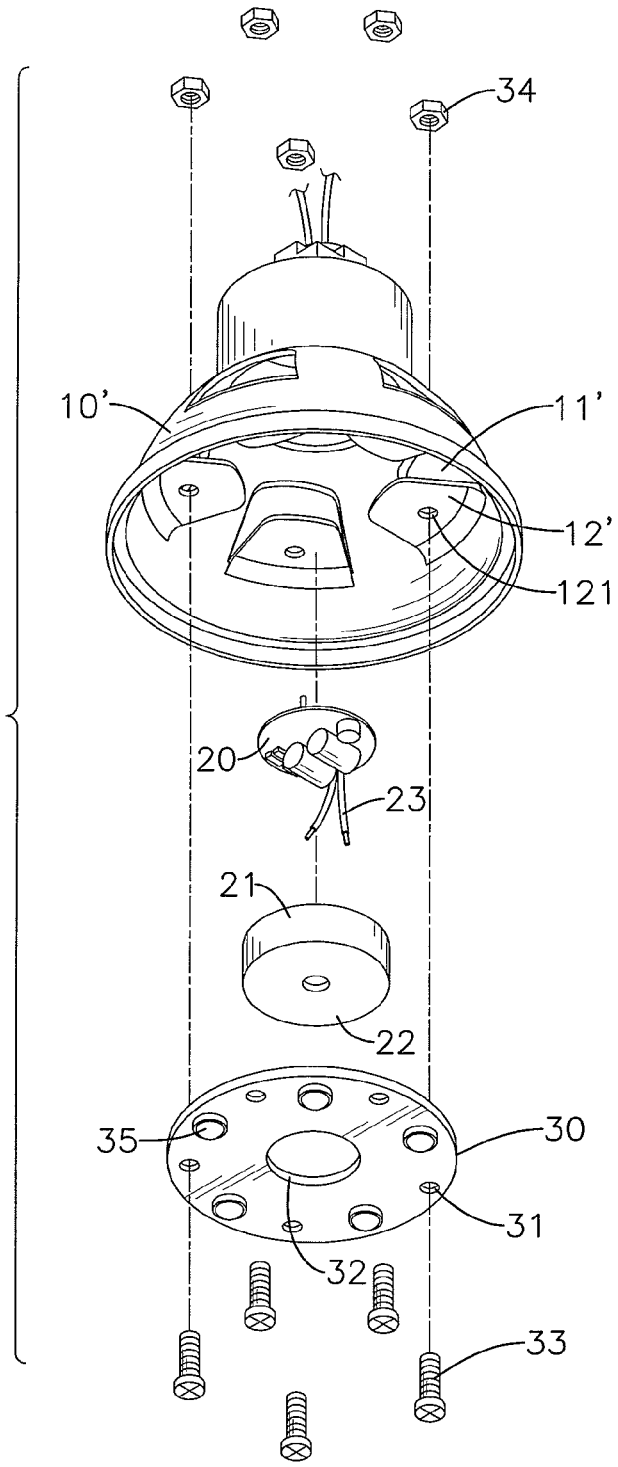
FIG. 4 is an exploded perspective view of another embodiment of a heat-dissipating structure for the LED lamp in accordance with the present invention.
Figure 5:
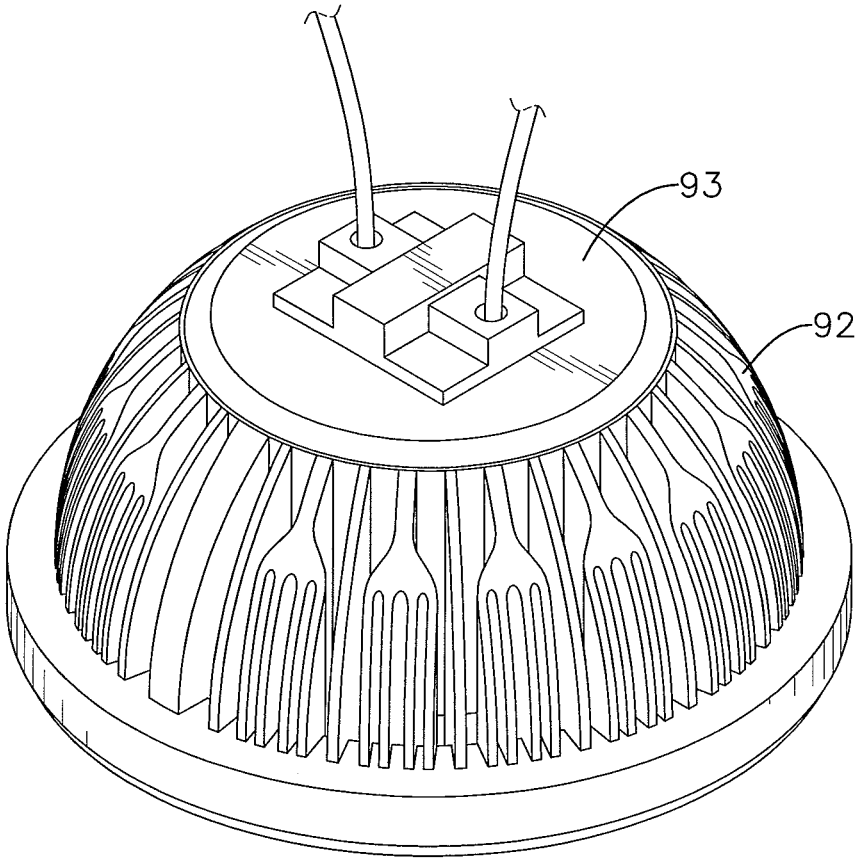
FIG. 5 PRIOR ART
FIG. 5 is a perspective view of a conventional LED lamp.
Figure 6:
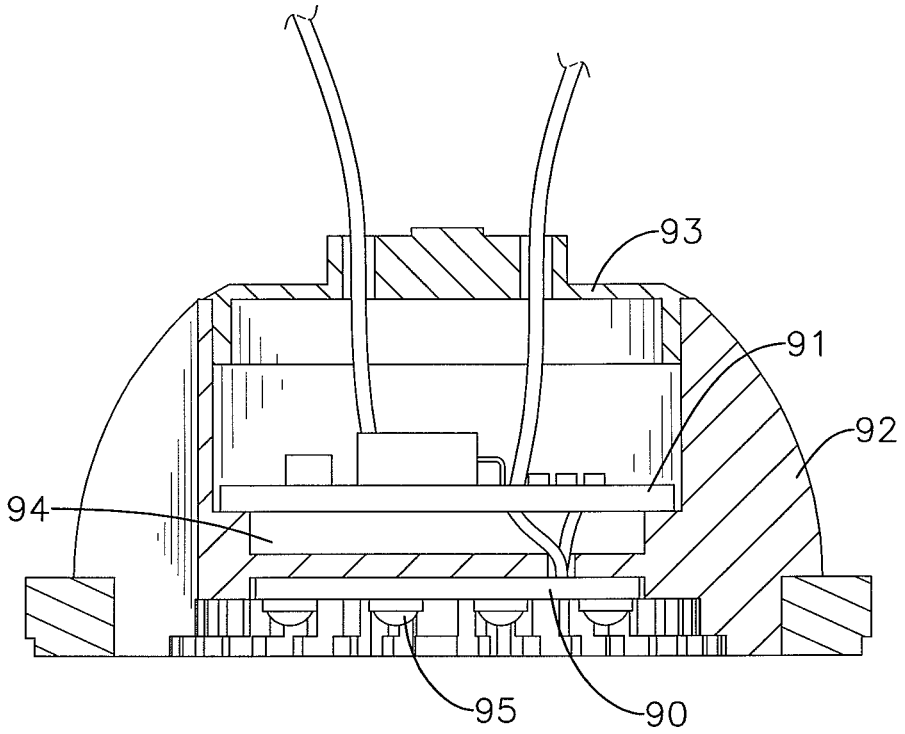
FIG.6 PRIOR ART
FIG. 6 is a side view in partial section of the conventional LED lamp.

With reference to FIG. 4, another embodiment of a heat-dissipating structure for a lamp in accordance with the present invention is roughly the same as the foregoing embodiment, and has a power conversion device 20 and a ceramic substrate 30 mounted on a lamp cover 10'. The lamp cover 10' has multiple heat-dissipating holes 11' and multiple mounting ears 12' formed on a peripheral wall of the lamp cover 10'. The ceramic substrate 30 is mounted on the mounting ears 12' of the lamp cover 10'. The present embodiment differs from the foregoing embodiment in that the heat-dissipating holes 11' differ from those of the foregoing embodiment in terms of number, shape, size and location, so that the air circulation between the air in a heat convection space 40 defined between the ceramic substrate 30 and the lamp cover 10' and external air in the ambient environment can be tailored to customers' requirements. As the thermal contact area between each mounting ear 12' and the ceramic substrate 30 can also differ from that in the foregoing embodiment in terms of shape and size, heat can be dissipated in a desired speed. Additionally, the lamp cover 10' can be tailored to have a customized shape depending on consumers' demands to adapt to different environments and achieve to be aesthetically attractive.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A heat-dissipating structure for LED lamp comprising:

a lamp cover having:

a peripheral wall of a funnel shape and having a front annular orifice and a rear annular orifice; and multiple mounting ears formed in the peripheral wall spaced from and intermediate the front and rear annular orifices, wherein each mounting ear is bent inwardly from the peripheral wall to define a heat-dissipating hole spaced from and intermediate the front and rear annular orifices and matching the mounting ear in size in the peripheral wall;

a ceramic substrate mounted inside the lamp cover intermediate the front and rear annular orifices, securely mounted on the mounting ears, and having:

multiple light-emitting diodes (LEDs) mounted on the ceramic substrate, wherein light generated by the multiple LEDs is reflected by the lamp cover to generate uniform light, and an air passage hole centrally formed through the ceramic substrate;

a power cap mounted inside the lamp cover between the rear annular orifice of the lamp cover and the ceramic substrate;

a power conversion device mounted on the rear annular orifice of the lamp cover, facing the ceramic substrate, and electrically connected to the multiple LEDs on the ceramic substrate; and a heat convection space surrounded by the ceramic substrate, the power cap, and the lamp cover, being hollow, and communicating with the heat-dissipating holes and the air passage, wherein heat generated by the LEDs is absorbed by the ceramic substrate and conducted to the mounting ears and the lamp cover, wherein heat absorbed by the ceramic substrate is transferred to the heat convection space by way of heat convection, wherein the power cap isolates heat generated by the LEDs, wherein heat generated by the power conversion device and absorbed by the power cap is transferred to the heat convection space, wherein heat on the lamp cover is transferred to ambient air, and wherein heat accumulating in the heat convection space is transferred to the ambient air through the heat-dissipating holes of the lamp cover and through the air passage hole.

2. The heat-dissipating structure for LED lamp as claimed in claim 1, wherein the power cap mounted inside the lamp cover has a cable hole formed through the power cap.

3. The heat-dissipating structure for LED lamp as claimed in claim 2, wherein:

each mounting ear has a through hole formed through the mounting ear;

the ceramic substrate further has:

multiple threaded holes, with each threaded hole formed through the ceramic substrate to correspond to the through hole of a corresponding mounting ear; and multiple bolts, with each bolt mounted through one of the threaded holes of the ceramic substrate and the through hole of the corresponding mounting ear and screwed with a nut.

4. The heat-dissipating structure for LED lamp as claimed in claim 1, wherein at least one power cable is connected between the power conversion device and the ceramic substrate.

5. The heat-dissipating structure for LED lamp as claimed in claim 2, wherein at least one power cable is connected between the power conversion device and the ceramic substrate.

6. The heat-dissipating structure for LED lamp as claimed in claim 3, wherein at least one power cable is connected between the power conversion device and the ceramic substrate.

* * * * *